United States Patent [19]

Inglis

[11] 4,195,780

[45] Apr. 1, 1980

[54] FLOW AMPLIFYING NOZZLE

[75] Inventor: Leslie R. Inglis, Cincinnati, Ohio

[73] Assignee: Vortec Corporation, Cincinnati, Ohio

[21] Appl. No.: 973,691

[22] Filed: Dec. 27, 1978

Related U.S. Application Data

[63] Continuation-in-part of Ser. No. 856,291, Dec. 1, 1977, abandoned.

[51] Int. Cl.[2] ..... B05B 1/06; B05B 1/30

[52] U.S. Cl. ..... 239/73; 239/433; 239/457; 239/541; 239/579; 239/581; 417/187; 417/197; 417/198

[58] Field of Search ..... 417/187, 197, 198; 261/76, 78 R, 78 A, DIG. 75; 239/71, 73, 74, 270, 417, 418, 424, 425.5, 433, 434.5, 457, 537–541, 579, 581, 583, 586, 590.5, DIG. 3, DIG. 7

[56] References Cited

U.S. PATENT DOCUMENTS

| | | | |
|---|---|---|---|
| 3,618,857 | 11/1971 | Rautenbach et al. | 239/581 X |
| 3,735,778 | 5/1973 | Garnier | 239/DIG. 7 X |
| 3,743,186 | 7/1973 | Mocarski | 239/433 X |
| 3,984,054 | 10/1976 | Frochaux | 239/DIG. 7 X |
| 4,046,492 | 9/1977 | Inglis | 417/197 |
| 4,090,814 | 5/1978 | Teodorescu et al. | 417/197 X |

*Primary Examiner*—Robert B. Reeves
*Assistant Examiner*—Andres Kashnikow
*Attorney, Agent, or Firm*—Tilton, Fallon, Lungmus & Chestnut

[57] ABSTRACT

An adjustable nozzle for directing and amplifying the flow of compressed air or other pressurized fluid. The nozzle includes a rear body section and a front nozzle section, the two sections being threadedly connected to define a forwardly-facing flow-directing passage and a radially-extending metering passage communicating with the flow-directing passage. The size of the metering passage may be selectively adjusted without altering the cross-sectional dimensions of the flow-directing passage by rotating the nozzle section into any selected position of threaded adjustment upon the body section, such position (and the relative dimension of the metering section) being indicated by micrometer markings upon the exposed surfaces of the respective sections.

24 Claims, 7 Drawing Figures

FLOW AMPLIFYING NOZZLE

RELATED APPLICATION

This application is a continuation-in-part of my copending application Ser. No. 856,291, filed Dec. 1, 1977 now abandoned.

BACKGROUND AND SUMMARY

Nozzles for the discharge of pressurized fluids, and for amplifying the flow thereof by mixing such fluids with secondary fluids, are well known. At least one such nozzle is provided with a nose piece for directing a high velocity stream of primary air over its tapered exterior surface, such primary air then entraining large quantities of surrounding air (secondary air) to create a total flow many times greater than that of the primary air alone. The primary air is discharged radially from a thin slot adjacent the enlarged end of the nozzle and the high velocity stream then alters its direction to follow the tapered external contour of the nozzle because of an attachment phenomenon commonly known as the Coanda effect. A discussion of that effect is set forth in Coanda U.S. Pat. No. 2,052,869. Other fluid flow devices utilizing the Coanda effect are disclosed in U.S. Pat. Nos. 3,806,039, 3,795,367, and 3,743,186 although, unlike the external-flow nozzle already described, each of such devices discharges pressurized air inwardly into an axial internal flow passage.

One disadvantage of Coanda-type nozzles is that the attachment effect of a high velocity stream with respect to a flow-directing wall surface is pressure dependent and, should the pressure momentarily exceed a maximum level, the air discharged from an external flow nozzle will "switch off" from the wall surface and will spray radially outwardly from the nozzle. Thus, a surge in pressure in an industrial air line would, if the attachment limit were exceeded, render such a nozzle inoperative until such time as the air to the nozzle were either cut off and then resumed at a normal lower pressure or were reduced well below the normal pressure until reattachment of the flow to the nozzle surface reoccurred. In either case, taking corrective measures to restore operation of a Coanda nozzle may be inconvenient, time consuming, and hence, costly.

Other types of nozzles have been known which do not utilize the Coanda effect but which instead discharge compressed air in a fine stream surrounding a tapered nose piece and in a direction parallel to the axis of that nose piece. Metering of the discharged primary air occurs between the outer diameter of the tapered nose piece and the inner diameter of the body into which the nose piece fits. Such nozzles are rarely if ever adjustable and are easily damaged because even a slight deformation of the surrounding skirt portion of the body (as might readily occur if the nozzle were bumped or dropped) would alter the size and configuration of the annular metering orifice.

Accordingly, it is an object of this invention to provide an improved flow-amplifying nozzle which has the advantages of prior external-flow nozzles, whether of the Coanda type or not, without the noted disadvantages of such prior structures. Such an object is achieved at least in part, by providing a flow-amplifying nozzle which has an adjustable metering passage extending in a plane normal to the axis of the nozzle and communicating with an axially-extending flow-directing passage, the latter passage being relatively large in cross sectional area, being uniform in such cross sectional area throughout its entire longitudinal extent, and performing no significant metering function.

Another aspect of this invention lies in providing a nozzle which, unlike a Coanda-type nozzle, is not likely to be rendered inoperative by sudden surges in line pressure. Other objects lie in providing a nozzle wnich is relatively simple and durable in construction, is less likely to become clogged than prior nozzle constructions, is readily adjustable, may be easily disassembled whenever cleaning or repair becomes necessary, and may be conveniently and accurately adjusted to reestablish its flow setting after cleaning and reassembly.

In brief, the nozzle includes a rear body section and a forwardly-tapering nozzle or nose section. The body section includes an axial portion, a cylindrical sleeve portion which is spaced radially (either outwardly or inwardly) from the axial portion, and an annular transverse wall portion extending between the axial and sleeve portions, all three portions together defining a forwardly-facing annular recess. The nozzle section is threadedly mounted upon the axial portion and has a rearwardly-projecting collar received within the forwardly-facing recess. The collar is spaced radially from the sleeve portion to form an annular flow-directing passage of substantially uniform cross sectional area. The rear face of the collar is movable in relation to the transverse wall portion of the body to define a selectively variable metering passage for controlling the flow of primary fluid from the nozzle as the threaded nozzle section is rotated in one direction or the other upon the body section.

Air escaping from the nozzle must therefore pass first through the radially-extending metering passage and then through the annular flow-directing passage. The ratio between the cross sectional area of the flow-directing passage and the maximum effective area of the metering passage should fall within the general range of about 1:1 to 2:1 and preferably within the narrower range of about 1:1 to 1.2:1. Such ratios insure that during operation of the nozzle the metering of primary air occurs within the metering passage, not within the flow-directing passage, and that the flow-directing passage will operate effectively to control the direction of airflow without appreciably reducing the velocity of that flow.

The size of the metering passage is selectively controlled by rotating the threadedly-connected body and nozzle sections with respect to each other. The range of operative settings is revealed by markings on the respective parts, preferably in the form of a micrometer scale on one of the parts and an index marking on the other. The scale encompasses the full range of effective positions of adjustment ranging from a closed position (in which, if desired, flow may be completely blocked) to a fully open position (in which the metering passage has its maximum effective operating area). Locking means in the form of a set screw may be used to lock the sections of the nozzle in any selected operating position.

Other features, objects, and advantages of the nozzle will become apparent from the specification and drawings.

DRAWINGS

DETAILED DESCRIPTION

Figure 1:
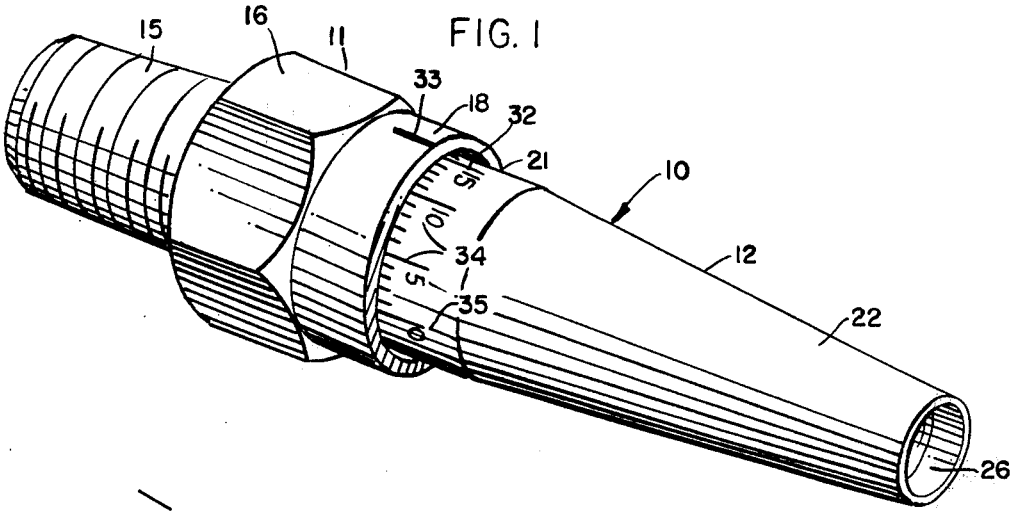
FIG. 1 is a perspective view of a nozzle embodying the present invention.

The numeral 10 generally designates a nozzle having a rear body section 11 and a front nozzle section 12. The body section is tubular and defines an axial passage 13 and at least one transverse passage 14 for conveying compressed air or some other pressurized primary fluid. As shown, the rear portion 15 of the body section may be externally threaded for attachment to a hose or pressure line. An intermediate portion 16 of the body section may have flat external surfaces for engagement with a suitable wrench or tool to facilitate attachment and detachment of the nozzle from a supply hose.

Figure 2:
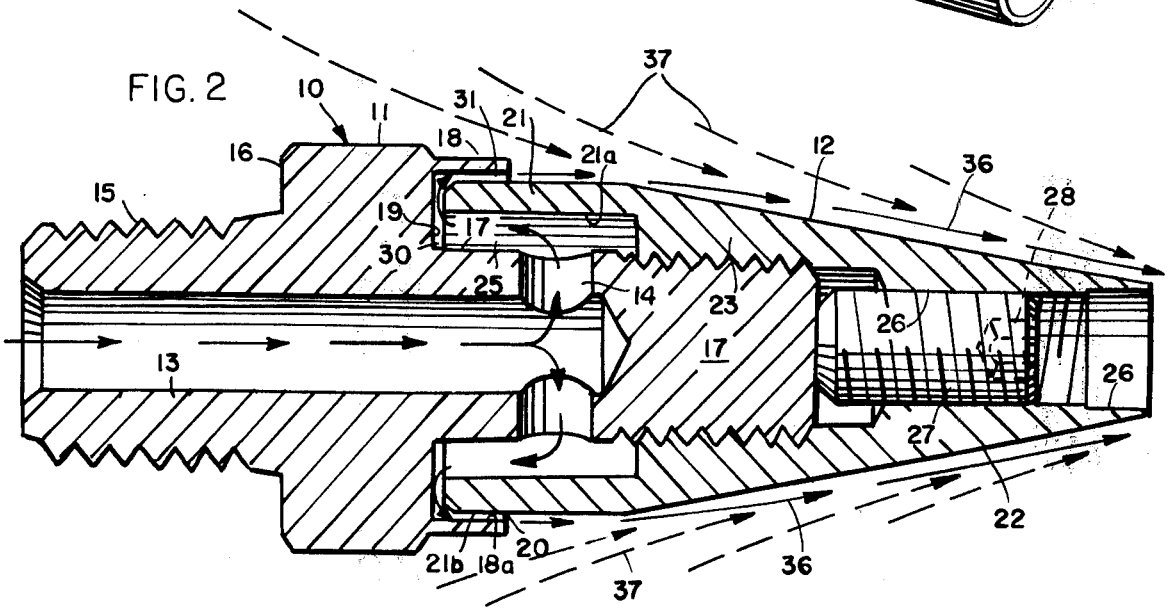
FIG. 2 is a longitudinal sectional view of the nozzle.

The body section 11 also includes a forwardly-projecting axial portion 17, a cylindrical sleeve portion 18 spaced outwardly from the axial portion, and an annular transverse wall portion 19 extending between the axial and sleeve portions. As shown most clearly in FIG. 2, the outer surface of axial portion 17 and the inner surface of sleeve portion 18 combine with wall portion 19 to define a forwardly-facing annular recess 20.

The nozzle section 12 has a cylindrical collar portion 21 and a frusto-conical forwardly-tapering front portion 22. In the embodiment shown, a stepped axial bore extends through the nozzle section. The intermediate portion of the bore is threaded at 23 and engages the externally threaded axial portion 17 of the body section. The enlarged rear end portion of the bore is substantially larger in diameter than the axial portion 17 to define an annular distribution chamber 25 communicating with passages 14 and 13. The reduced front end 26 of the bore threadedly receives a screw 27 which may be adjusted by a suitable wrench (such as a hex wrench inserted into opening 28) into forceful engagement with axial portion 17 to lock the nozzle section in a selected position of adjustment with respect to the body section 11.

Figure 3:
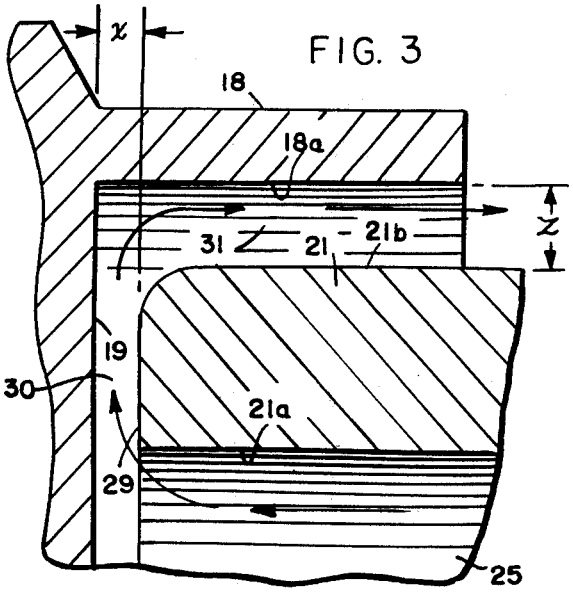
FIG. 3 is an enlarged fragmentary longitudinal sectional view illustrating the sections of the nozzle in one condition of operation.
Figure 4:
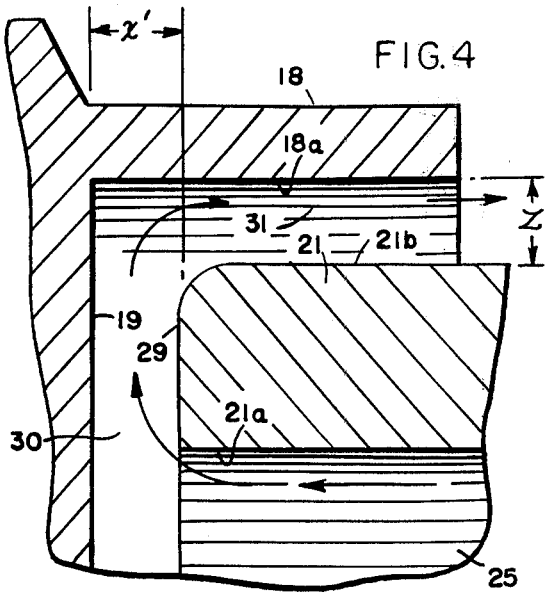
FIG. 4 is a fragmentary sectional view similar to FIG. 3 but illustrating the sections in a second condition of operation.

When the parts are assembled as illustrated in the drawings, the annular rear surface of collar 21 is spaced from the transverse wall 19 of the body section to define a metering passage 30 therebetween. It is believed apparent that the size of the metering passage may be varied by rotating the nozzle section 12 one way or the other upon the threaded axial portion of the body section 11. FIG. 3 illustrates a typical position of adjustment, the spacing x between the opposing planar transverse surfaces 19 and 29 being such that the effective area of the metering passage (equal to $\pi Dx$ where D equals the inside diameter 21*a* of the cylindrical collar 21) is substantially less than the cross sectional area of the axially-extending flow-directing passage 31. FIG. 4, on the other hand, illustrates a second position of adjustment with maximum operative spacing x' between surfaces 19 and 29, that is, with the metering passage adjusted to provide maximum operative flow area. It will be noted that the radial distance z between the inner surface 18*a* of sleeve portion 18 and the outer surface 21*b* of collar 21 remains constant and, hence, the cross sectional area of the cylindrical flow-directing passage 31 does not change regardless of the position of adjustment of the nozzle and body sections. The cross sectional area of the elongated flow-directing passage 31 should not be less than the maximum effective operating area of the metering passage 30 (i.e., $\pi Dx'$) and should not exceed twice such maximum effective operating area of the metering passage. Stated differently, the ratio of the area of flow-directing passage 31 to the maximum effective operating area of metering passage 30 should fall within the range of 1:1 to 2:1, and preferably within the range of 1:1 to 1.2:1. At ratios above 2:1 the passage 31 loses its effectiveness in directing the flow of primary air and, in addition, causes an appreciable loss in velocity of that air, whereas at ratios below 1:1 the metering function is no longer effectively performed by metering passage 30 but is taken over by passage 31.

Suitable markings in the form of a scale 32 and an index mark 33 are applied to the exposed surfaces of collar 21 and sleeve 18. While the sleeve is shown to be provided with the index mark 33 and the collar is illustrated as having scale 32, it will be understood that the markings on the parts might be reversed. The scale includes graduation marks 34 and numerals 35 which represent the full range of operative positions of the parts. The numerals 35 may thus represent the full range of distances x when the nozzle section is adjusted over its full range of operative positions, it being understood that in this context a "0" distance represents an operative position because the nozzle operates effectively to block the flow of primary fluid. The numeral "15" may represent a distance x of 0.015 inch, the spacing between each of the lines thus representing an incremental change in spacing x of 0.001 inch. It is believed apparent, therefore, that a high degree of accuracy in adjusting the dimensions of the metering passage may be achieved.

In operation of the nozzle, primary air entering passage 13 flows into the distribution chamber 25 and then, assuming the metering passage 30 is not fully closed, flows radially outwardly through the metering passage and forwardly through the flow-directing passage 31. The forwardly discharged primary air is represented by solid arrows 36 in FIG. 2. Such primary air, escaping at high velocity from the nozzle, entrains large quantities of secondary air surrounding the nozzle, drawing such secondary air forwardly as indicated by broken arrows 37 in FIG. 2. The flow of air from the nozzle is thereby amplified to create a total flow which may be 25 or more times as great as the flow of primary air alone.

Once the nozzle has been adjusted into a proper setting for a given application, hex screw 27 may be tightened against the axial portion 17 to lock the nose and body sections together. Whenever resetting or readjustment of the nozzle is required, or whenever cleaning or repair becomes necessary, the parts may be disassembled by simply loosening screw 27 and unthreading the nozzle section 12 from body section 11.

In the embodiment depicted in FIGS. 1–4, the mixing of primary and secondary air occurs externally of nozzle section 12. The gradual taper of the front portion 22 is significant because it tends to direct the flow of primary and secondary air forwardly and inwardly, thereby overcoming or offsetting the tendency of the rapidly flowing air to diverge. The taper thereby promotes directivity of the air stream, an advantage of particular importance where the nozzle is to be used as a cleaning device for blowing particulate matter and possibly liquids off of workpieces. Where such directivity is of lesser importance and maximum amplification is desired, the nozzle section 12 may be provided with an untapered or cylindrical outside surface.

Figure 5:
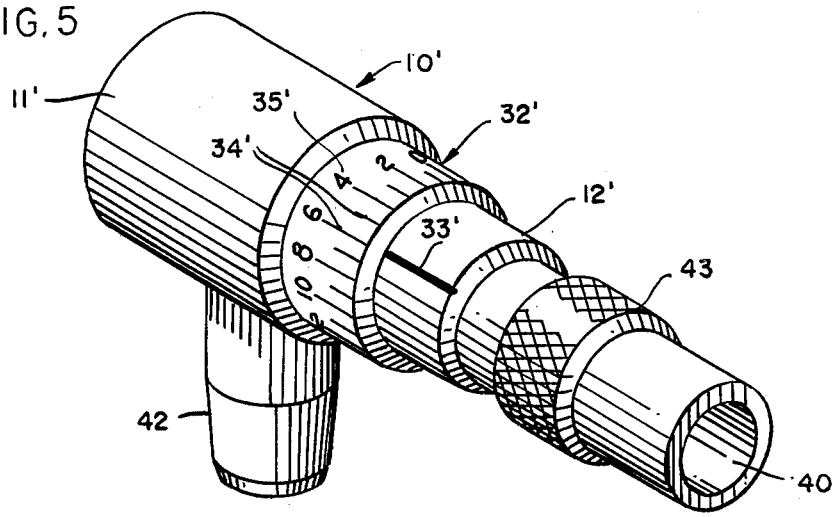
FIG. 5 is a perspective view of a nozzle constituting a second embodiment of this invention.
Figure 6:
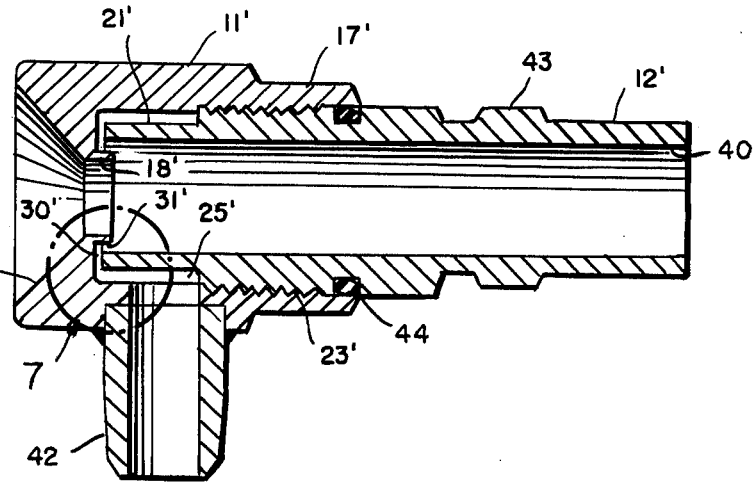
FIG. 6 is a longitudinal sectional view of the nozzle of FIG. 5.
Figure 7:
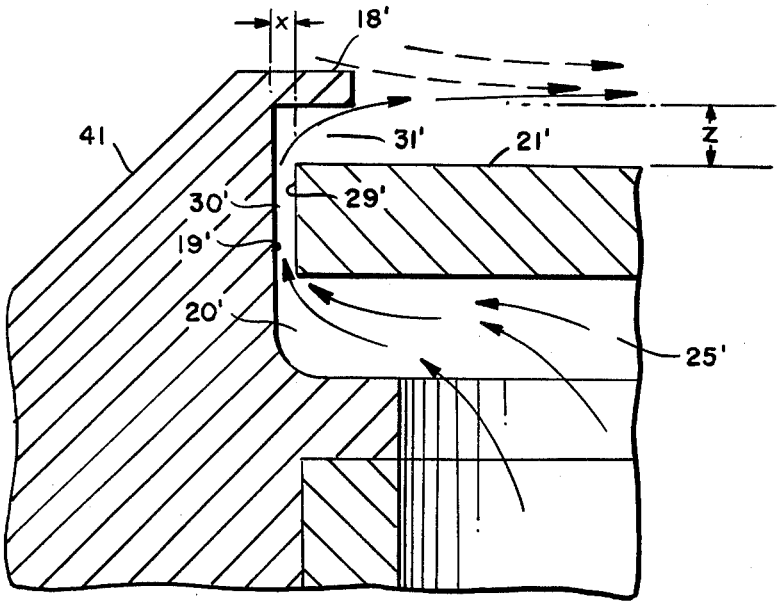
FIG. 7 is an enlarged fragmentary sectional view of that portion of the nozzle indicated by a circular broken line in FIG. 6.

As shown in FIGS. 5–7, the basic features of this invention may also be embodied in a nozzle in which the mixing of primary and secondary air occurs internally rather than externally. Like nozzle 10, nozzle 10' has a rear body section 11' and a front nozzle section 12'. The body section includes a forwardly-projecting axial portion 17', a cylindrical sleeve portion 18' spaced radially from the axial portion, and an annular transverse wall portion 19' extending between the axial portion and sleeve portion. As before, the surfaces of the axial portion and sleeve portion combine with the wall portion to define a forwardly-facing annular recess 20'.

The nozzle section 12' is externally threaded at 23' and, as shown most clearly in FIG. 6, is threadedly received within the internally-threaded axial portion 17' of the body section 11'. A bore 40, shown to be of uniform cross sectional dimensions throughout its longitudinal extent, and is axially aligned with a passage 41 in body section 11'. When the parts are assembled as illustrated in the drawings, the rearwardly-projecting cylindrical collar portion 21' of the nozzle section is disposed within the recess 20' of the body section, the annular rear surface of the collar being spaced from transverse wall 19' to define a metering passage 30' therebetween. The size of the metering passage may be varied by rotating the nozzle section one way or the other with respect to the body section. FIG. 7 depicts a typical position of adjustment with the spacing x between the opposing planar transverse surfaces 19' and 29' being such that the effective area of the metering passage (equal to $\pi DX$ where D equals the inside diameter of the cylindrical collar portion 21') is substantially less than the cross sectional area of the axially-extending flow-directing passage 31'. The cross sectional area of the annular flow-directing passage 31' should not be less than the maximum effective operating area of the metering passage 30' and should not exceed twice such maximum effective operating area of the metering passage. Therefore, as before, the ratio of the cross sectional area of the flow directing passage to the metering passage should fall within the general range of about 1:1 to 2:1 and preferably within the narrower range of 1:1 to 1.2:1. Regardless of the position of adjustment of the parts within the specified range, it is to be noted that the radial distance Z between the inner cylindrical surface of collar portion 21' and the outer cylindrical surface of sleeve portion 18' will remain constant.

Suitable markings in the form of scale 32' and an index mark 33' are applied to the exposed surfaces of the body and nozzle sections as shown in FIG. 5. The scale includes graduation marks 34' and numerals 35' which represent the full range of operative positions of the parts. As before, the spacing between each of the lines may represent an incremental change in spacing X of 0.001 inch.

In operation of the nozzle depicted in FIGS. 5–7, primary air under pressure flows radially inwardly into a distribution chamber 25' through inlet 42. The primary air then flows radially inwardly through metering passage 30' and forwardly through the flow-directing passage 31', the direction of such primary air being represented by solid arrows in FIG. 7. Upon leaving the flow-directing passage 31', the primary air entrains large quantities of secondary air entering the bore 40 of the nozzle section from the inlet 41 of the body section. The secondary air, represented in FIG. 7 by broken arrows, is carried through the bore by the rapidly flowing primary air and is discharged from the distal end of the nozzle as an amplified stream of rapidly moving air. To minimize divergence of the discharged air, the bore 40 of the nozzle section should be straight (i.e., cylindrical) as shown; however, it is to be understood that the bore may be tapered forwardly and outwardly if directivity is to be sacrificed in favor of greater amplification or other desired effects.

To assist in adjustment of the nozzle, the nozzle section 12' may have an enlarged externally-knurled portion 43. In addition, to prevent leakage of air along the outer surface of the nozzle section, a resilient sealing ring 44 may be mounted in a suitable annular groove of the nozzle section to make slidable sealing contact with the inner surface of the axial portion 17' of the body section 11'.

While in the foregoing embodiments of the invention has been disclosed in considerable detail for purposes of illustration, it will be understood by those skilled in the art that many of these details may be varied without departing from the spirit and scope of the invention.

I claim:

1. A fluid-directing flow-amplifying nozzle comprising a rear body section and a forwardly-extending nozzle section; said body section including an axial portion, a cylindrical sleeve portion spaced radially from said axial portion, and an annular transverse wall portion extending therebetween; said axial, sleeve, and wall portions together defining a forwardly-facing annular recess; said nozzle section being threadedly and adjustably connected to said axial portion and having a rearwardly-projecting cylindrical collar received within said forwardly-facing recess; said collar being spaced radially from said axial portion to define an annular distribution chamber therebetween and being spaced radially from said sleeve portion to form an annular forwardly-extending flow-directing passage; and passage means provided by said body section for conducting a primary fluid under pressure into said distribution chamber; said collar having a rearwardly-facing annular surface movable in relation to said transverse wall portion of said body to define a selectively variable metering passage for altering the flow of primary fluid from said nozzle as the position of said threaded nozzle section is adjusted with respect to said body section.

2. The nozzle of claim 1 in which said transverse wall portion extends along a plane normal to the longitudinal axis of said nozzle.

3. The nozzle of claim 1 in which said rearwardly-facing annular surface of said collar extends along a plane normal to the longitudinal axis of said nozzle.

4. The nozzle of claim 1 in which the ratio of the cross sectional area of said flow-directing passage to the maximum effective area of said metering passage falls within the range of about 1:1 to 2:1.

5. The nozzle of claim 1 in which said annular flow-directing passage is of substantially uniform cross sectional area throughout its length.

6. The nozzle of claim 1 in which one of said sections is provided with a series of circumferentially-spaced markings and the other of said sections is provided with an index mark alignable with each of said markings upon movement of said nozzle section into selected positions of adjustment.

7. A fluid-directing flow-amplifying nozzle comprising a rear body section and a forwardly-tapered nozzle section; said body section including an axial portion, a cylindrical sleeve portion spaced radially from said axial portion, and an annular wall portion extending therebetween and lying along a transverse plane normal to the longitudinal axis of said nozzle; said axial, sleeve, and wall portions together defining a forwardly-facing annular recess; said nozzle section being threadedly and adjustably connected to said axial portion and having a rearwardly-projecting cylindrical collar received within said forwardly-facing recess; said collar being spaced radially from said axial portion to define an annular distribution chamber therebetween and being spaced radially from said sleeve portion to form an annular flow-directing passage of substantially uniform cross sectional dimensions throughout its length; and passage means provided by said body section for conducting a primary fluid under pressure into said chamber; said collar having a rearwardly-facing annular surface extending along a plane normal to the axis of said nozzle and movable in relation to said wall portion of said body to define a selectively variable metering passage for metering the flow of primary fluid from said distribution chamber into said flow-directing passage.

8. The nozzle of claim 7 in which the ratio of the cross sectional area of said flow-directing passage to the maximum effective operating area of said metering passage falls within the range of about 1:1 to 2:1.

9. The nozzle of claim 7 in which one of said sections is provided with a series of circumferentially-spaced markings and the other of said sections is provided with an index mark alignable with each of said markings upon movement of said nozzle section into selected positions of adjustment.

10. A fluid-directing flow-amplifying nozzle comprising a rear body section and a forwardly-tapered nozzle section, said body section including an axial portion, a cylindrical sleeve portion spaced outwardly from said axial portion, and an annular transverse wall portion extending therebetween; said axial, sleeve, and wall portions together defining a forwardly-facing annular recess; said nozzle section being threadedly and adjustably mounted upon said axial portion and having a rearwardly-projecting cylindrical collar received within said forwardly-facing recess; said collar being spaced outwardly from said axial portion to define an annular distribution chamber therebetween and being spaced inwardly from the inside surface of said sleeve portion to form an annular forwardly-extending flow-directing passage; and passage means provided by said body section for conducting a primary fluid under pressure into said distribution chamber; said collar having a rearwardly-facing annular surface movable in relation to said transverse wall portion of said body to define a selectively variable metering passage for altering the flow of primary fluid from said nozzle as the position of said threaded nozzle section upon said axial portion is adjusted.

11. The nozzle of claim 10 in which said transverse wall portion extends along a plane normal to the longitudinal axis of said nozzle.

12. The nozzle of claim 10 in which said rearwardly-facing annular surface of said collar extends along a plane normal to the longitudinal axis of said nozzle.

13. The nozzle of claim 10 in which the ratio of the cross sectional area of said flow-directing passage to the maximum effective area of said metering passage falls within the range of about 1:1 to 2:1.

14. The nozzle of claim 13 in which said ratio falls within the range of 1:1 to 1.2:1.

15. The nozzle of claim 10 in which said annular flow-directing passage is of substantially uniform cross sectional area throughout its length.

16. The nozzle of claim 10 in which one of said sections is provided with a series of circumferentially-spaced markings and the other of said sections is provided with an index mark alignable with each of said markings upon movement of said nozzle section into selected positions of adjustment.

17. The nozzle of claim 16 in which said series of markings is provided along the outer surface of said collar and said index mark is provided upon the outer surface of said sleeve.

18. The nozzle of claim 10 in which said passage means includes a passage extending axially into said axial portion and at least one opening extending transversely from said passage into said annular distribution chamber.

19. A fluid-directing flow-amplifying nozzle comprising a rear body section and a forwardly-extending nozzle section; said body section including an axial portion, a cylindrical sleeve portion spaced inwardly from said axial portion, and an annular transverse wall portion extending therebetween; said axial, sleeve, and wall portions together defining a forwardly-facing annular recess; said nozzle section being threadedly and adjustably connected to said axial portion and having a rearwardly-projecting cylindrical collar received within said forwardly-facing recess; said collar being spaced inwardly from said axial portion to define an annular distribution chamber therebetween and being spaced outwardly from the outer surface of said sleeve portion to form an annular forwardly-extending flow-directing passage; and passage means provided by said body section for conducting a primary fluid under pressure into said distribution chamber; said collar having a rearwardly-facing annular surface movable in relation to said transverse wall portion of said body to define a selectively variable metering passage for altering the flow of primary fluid from said nozzle as the position of said threaded nozzle section is adjusted with respect to said body section.

20. The nozzle of claim 19 in which said transverse wall portion extends along a plane normal to the longitudinal axis of said nozzle.

21. The nozzle of claim 19 in which said rearwardly-facing annular surface of said collar extends along a plane normal to the longitudinal axis of said nozzle.

22. The nozzle of claim 19 in which the ratio of the cross sectional area of said flow-directing passage to the maximum effective area of said metering passage falls within the range of about 1:1 to 2:1.

23. The nozzle of claim 19 in which said annular flow-directing passage is of substantially uniform cross sectional area throughout its length.

24. The nozzle of claim 19 in which one of said sections is provided with a series of circumferentially-spaced markings and the other of said sections is provided with an index mark alignable with each of said markings upon movement of said nozzle section into selected positions of adjustment.

* * * * *